US005387782A

United States Patent [19]

Holik

[11] Patent Number: 5,387,782

[45] Date of Patent: Feb. 7, 1995

[54] APPARATUS FOR SMOOTHING PAPER WEBS

[75] Inventor: Herbert Holik, Ravensburg, Germany

[73] Assignee: Sulzer-Escher Wyss GmbH, Ravensburg, Germany

[21] Appl. No.: 868,612

[22] Filed: Apr. 14, 1992

[30] Foreign Application Priority Data

Apr. 17, 1991 [DE] Germany ..... 4112537

[51] Int. Cl.[6] ..... H05B 6/62

[52] U.S. Cl. ..... 219/773; 219/770; 219/774; 219/777

[58] Field of Search ..... 219/10.61 R, 10.43, 219/10.67, 10.69, 10.77, 10.81, 770, 773, 774, 775, 776, 777; 34/1; 162/100; 156/270

[56] References Cited

U.S. PATENT DOCUMENTS

| | | | |
|---|---|---|---|
| 2,088,893 | 8/1937 | Cates | 162/231 |
| 2,214,641 | 9/1940 | Massey | 162/175 |
| 3,866,255 | 2/1975 | Serota | 219/10.61 R |
| 4,111,744 | 9/1978 | Reiniger | 162/100 |
| 4,359,826 | 11/1982 | Rounsley | 34/1 |
| 4,873,407 | 6/1989 | Smith | 219/10.43 |
| 4,994,133 | 2/1991 | Oizumi et al. | 156/270 |

FOREIGN PATENT DOCUMENTS

| | | |
|---|---|---|
| 387803B | 3/1989 | Austria . |
| 0141614 | 5/1985 | European Pat. Off. . |
| 0341457 | 11/1989 | European Pat. Off. . |
| 0245250 | 5/1990 | European Pat. Off. . |
| 3741680A1 | 6/1989 | Germany . |
| 511259 | 8/1939 | United Kingdom . |

OTHER PUBLICATIONS

M. F. Gratton, et al. "The Effects of Z-Direction Moisture and Temperature Gradients in the Calendering of Newsprint" in: Journal of Pulp and Paper Science, vol. 14, No. 4, Jul. 1988; pp. J82–J90.

T. L. Wilson. "An updated review of dielectric heating in the paper, pulp, and board industries" in: Tappi Journal, vol. 57, No. 12, Dec. 1974; pp. 134–138.

R. N. Vyse. "Practical aspects of calender steam showers" in: Tappi Journal, vol. 71, No. 10, Oct. 1988; pp. 87–90.

*Primary Examiner*—Bruce A. Reynolds
*Assistant Examiner*—Tu Hoang
*Attorney, Agent, or Firm*—Townsend and Townsend Khourie and Crew

[57] ABSTRACT

The invention relates to an apparatus for the generation of smoothness in paper. The paper (1) is thereby supplied to the rolls (2) of the smoothing mechanism with a moisture distribution which is characterized in that the moisture content in the inner layers of the paper is substantially smaller or at least as large as in the outer layers. This can be achieved with the aid of a dielectric paper web heating device (3) which is positioned in front of the rolls (2) of the smoothing mechanism. Through the invention less energy is to be required for the same smoothness values and a lower reduction in volume is to take place.

7 Claims, 1 Drawing Sheet

APPARATUS FOR SMOOTHING PAPER WEBS

The invention relates to an apparatus for the generation of smoothness, i.e. for flattening or smoothing the surface of paper and similar fibre mats.

1. Field of the Invention

2. Description of the Prior Art

The use of dielectric heating is known per se in the field of paper making. One example of the use of dielectric heating is described in U.S. Pat. No. 4,873,407. As explained in U.S. Pat. No. 4,873,407, an interesting property of the dielectric heating effect is that water has a much higher dielectric constant than most other materials, especially air and paper. This means that there is a preferential heating at wetter areas of a web. It is pointed out in U.S. Pat. No. 4,873,407 that for a single power input to a set of electrodes spanning the width of the paper web there will be a strong tendency to preferentially dry the wetter areas of the web, resulting in a lessening of the moisture variation across the web. This natural tendency of a single dielectric heating unit does not however allow a segmented control to eliminate the moisture variation across the web altogether or to produce a desired profile of moisture variation across the web.

In the apparatus described in this U.S. Pat. No. 4,873,407, a plurality of discrete dielectric heating modules are thus provided transverse to the width of the paper web to control the moisture in the web in the cross machine direction. Thus, in this prior art patent specification, there is no disclosure of using dielectric heating to produce a moisture gradient in the paper such that the moisture content of the inner layers is less than that of the outer layers and of exploiting this moisture gradient for smoothing of the paper web.

A further discussion of dielectric heating is contained in the article "An up-dated review of dielectric heating in the paper, pulp an board industries" by T. L. Wilson, published in Tappi Volume 57 No. 12 of December 1974, pages 134–138. As explained in this publication the dielectric heating equation is:

$$P=2\pi E^2 fC \cos\theta$$

where

P=power, W

E=voltage gradient, V/in.

f=frequency

C=electrical capacity, farads (dependent on the material and its size)

It is pointed out in the publication that both C and cos $\theta$ increase with increasing moisture content in the material and that these changes in capacitance and power factor with moisture content explain why dielectric heating improves the moisture profile in a web of paper, pulp, or board. It is concluded in the publication that areas in the web having the higher moisture contents automatically receive more power because of their increased capacity and power factor, and that they consequently dry out more rapidly and continue to do so until the wetter areas no longer exist, resulting in an essentially uniform moisture profile.

This prior art reference is particularly concerned with drying paper webs, not however with smoothing them. In connection with the drying of paper webs it is explained that "a bonus effect" is known when using dielectric heating. More specifically it is explained that the drying characteristics of pulp, paper and board vary considerably depending on whether it is pulp or paper or board, whether it is coated, whether it is pressed, and even on the chemical and physical composition of the web. Any of these materials can be dried with high-frequency dielectric heating, and the moisture profile will be improved during drying. The reference points out that experience has indicated that the power required to remove a given amount of moisture may vary, depending on whether the web has a hard, dense surface. According to the reference it has been reported for certain products, that the use of dielectric drying has allowed cylinder dryers in the line after the dielectric dryer to become more effective in removing the moisture, even to the extent of removing more moisture than can be accounted for by the total added electric power supplied from the power line. It is this removal of more moisture than would correspond to the electrical power supplied which is called the "bonus effect".

The publication goes on to state that there are two possible explanations for this phenomenon. One is that better use is made of the dry end dryers because of increased speed of the machine and the ability to have a higher average moisture content at the reel because of the improved moisture profile. These effects would be noticed on all types of materials.

The second explanation, which fits past experience that pulp seems to show less of the "bonus effect" than does board, is described as follows:

> It is a generally accepted fact that as paper or board and, to a lesser extend, pulp are dried on cylinder or air dryers, the remaining moisture is concentrated in the central fibers of the web and is insulated from the drying heat by the drier fibres at the surface. This explains why the later dryers in a line are less effective than those at the wet end.

Dielectric heat, since it reaches all parts of a material simultaneously, causes a very rapid change in water from the liquid to the vapor state. The pressure generated by the sudden presence of vapor inside the web forces the vapor outward through the surface with considerable velocity, and this carries with it particles of liquid water. These are caught at the surface by the dense and hard-surface layers, which are sufficiently porous to permit passage of vapor. Thus, during the almost explosive change of state of some of the water, most of the remainder is moved to the surface where it can be more readily reached by the heat from subsequent steam cylinder or air dryers. These become more effective and remove the moisture more rapidly than without the dielectric heat.

Despite these recognitions there is no suggestion in the cited publication that the phenomena described there could be exploited in conjunction with cooled rolls to improve the smoothness of the paper.

To increase the smoothness of paper it is often necessary to use heated rolls in the smoothing mechanism in addition to large line forces. The relationships which must be taken into account in so doing with respect to the moisture content of the paper, the temperature of the rolls, the contact pressure and also the dwell time in the roll gap are set forth amongst other things in European Patent No. 245 250.

It is a disadvantage of the so called temperature gradient process that the surface temperatures of over 200° C. which are sometimes necessary lead to correspondingly high thermal losses through convection and radiation, are associated with a high degree of complexity of the machine and also place stringent requirements on the machine. Moreover, the contact pressures which are required lead to a considerable reduction in volume. The moisture content which is customary during this process, and which reduces across the thickness of the paper web towards the outside, is the reason for a correspondingly greater compression of the inner layers.

In the Austrian Patent Specification 387 803 B, and also in the Article "The Effects of Z-direction Moisture and Temperature Gradients in the Calendering of Newsprint" by M. F. Gratton and R.H. Crotogino in the Journal of Pulp and Paper Science, 1988, No. 4 pages 982–990, reference is therefore made to the moisture gradient process. In this process the surface of the paper web is treated in front of the nip of the smoothing mechanism with a steam or liquid jet, so that the moisture of the outer layers is increased. This however leads to an increase in the moisture content of the total paper web.

SUMMARY OF THE INVENTION

The present invention is thus based on the object of providing an apparatus for the generation of smoothness in paper which requires less energy for the same smoothness values and which leads to a lower reduction in volume of the paper. A low reduction in volume is, for example, important in order to preserve the strength and opacity of the paper.

In accordance with the invention this object is satisfied in that the paper web is supplied to the rolls of the rolling mechanism with a moisture distribution the characteristic of which consists in the moisture content in the inner layers of the paper being substantially less than or at most as large as in the outer layers.

An important consequence of this is that the inner layers are stiffer and are less easily plastically deformable than the outer layers.

To improve the result of the process it is expedient to reduce the air circulation in the region in which the moisture distribution is generated and/or to generate or maintain a high air humidity there and/or to introduce steam there.

In addition the moisture content of the outer layers can be increased by cooling of the rolls which contact the paper web, or by cooling the paper web itself, directly prior to or during the smoothing and by the associated condensation on the rolls or on the paper web, or also by moistening it. This leads to an additional increase of the moisture content across the thickness of the paper web towards the outside.

Prior to generating the moisture distribution the paper web should have a moisture content of 5–25% and thereafter 2–15%. The higher stiffness of the inner layers resulting from the improved moisture distribution and the better plastic deformability of the outer layers leads in total to improved smoothness values and to a lower compression of the paper web, i.e. to a lower reduction in volume.

The apparatus appropriate to the process consists of smoothing rolls and also a preceding dielectric paper web heating device. In the area of the paper web heating device the air circulation should be reduced and/or a high air humidity should be produced or maintained and/or steam should be introduced. Furthermore it is of advantage when at least one roll of the rolls additionally provided between the rolls of the smoothing mechanism and the paper web heating device and/or one of the rolls of the smoothing mechanism itself is cooled.

The dielectric heating offers the possibility of drying the paper web starting from the middle, whereas the drying process is precisely reversed with contact or convection drying. The high air humidity in the region of the dielectric heating device further assists the formation of the desired humidity profile.

BRIEF DESCRIPTION OF THE DRAWINGS

Other objects, features and advantages will become more apparent after referring to the following specification at attached drawings in which.

DESCRIPTION OF PREFERRED EMBODIMENTS

Figure 1:
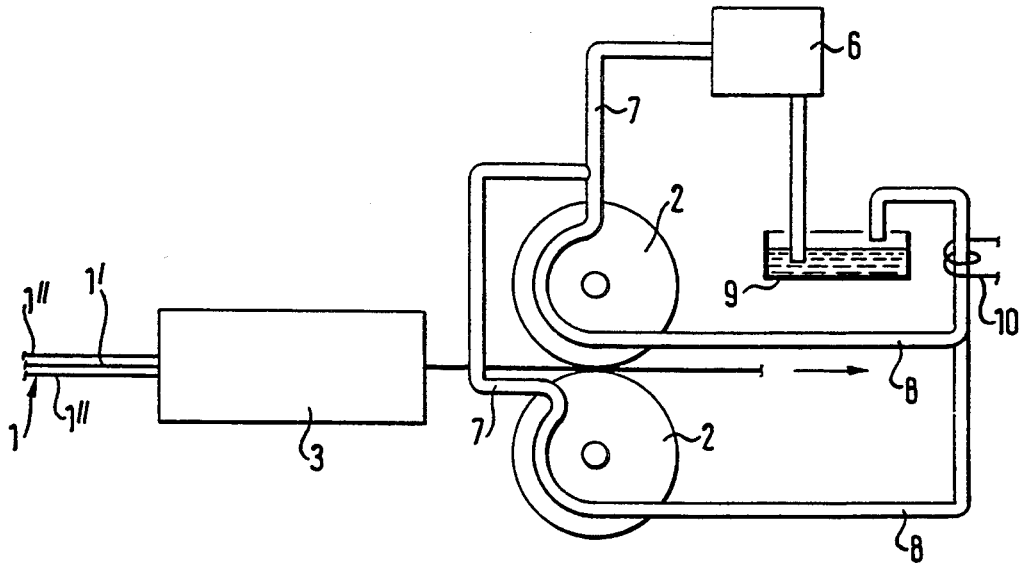
FIG. 1 is a schematic of a paper smoothing apparatus according to this invention illustrating schematically the paper coating having the required dielectric paper web heating device disposed to a supplied paper web having an inner layer with top and bottom outer layers; and, FIG. 2 is a schematic similar to FIG. 1 illustrating a chamber around the dielectric paper web heating device for supply a controlled atmosphere preferably of high humidity and with two additional and preferably cooled rollers within the chamber in advance of the similar rollers of FIG. 1.

As seen in FIG. 1 a paper web heating device 3 is arranged in front of the rolls 2 of the smoothing mechanism and operates on the basis of dielectric energy transfer to the moisture present in the web. As schematically indicated in FIG. 1 the web 1 comprises inner and outer layers 1' and 1'' respectively. These inner and outer layers which may also be termed surface and central layers are only shown at the extreme left-hand side of FIG. 1 but are actually present throughout the paper web in both FIGS. 1 and 2. It will be noted that the layers are typically not distinct, readily separable layers, but rather the paper web is conceptually considered as comprising inner and outer layers to explain its behaviour. In the usual way the paper web comprises a felted arrangement of fibrous material, typically on a cellulose basis.

Since the normal moisture distribution in the web upstream of the dielectric heating device is such that the moisture is concentrated in the inner, central layers of the web, the dielectric heating effect will be concentrated there. Thus the dielectric heating will generate a moisture distribution in the paper web such that the moisture content in the inner layers of the paper is now substantially less than or at the most as large as in the outer layers.

Since the inner layers of the paper web are dryer they are also stiffer and the rolls 2 are now able to smoothen the moist outer layers of the paper web 1. It will be noted that this is achieved with a lower overall moisture content of the paper web than would be achieved if, instead of drying the inner layers, water or steam were added to the outer layers.

Figure 2:
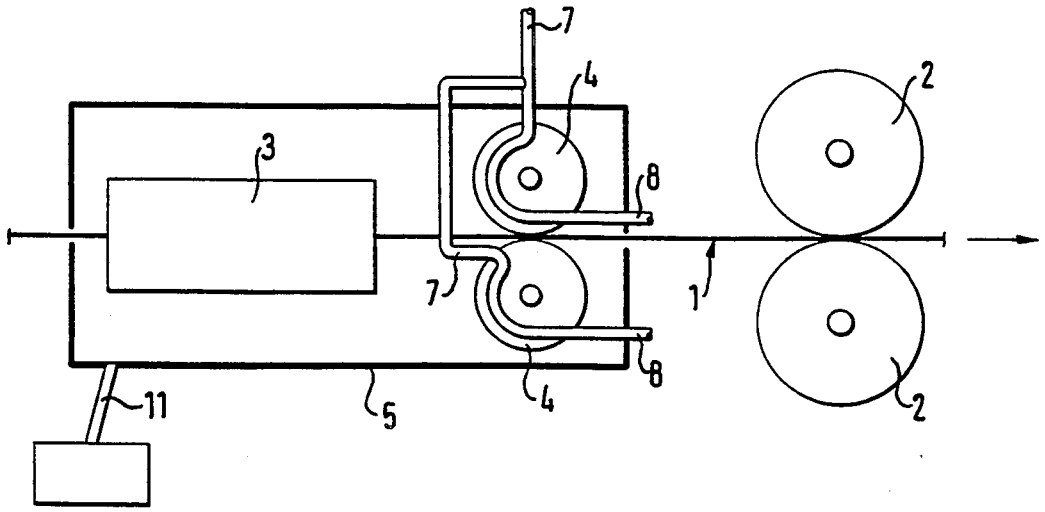

The paper web heating device 3 advantageously has a closed construction or, as shown in FIG. 2, a housing 5 forming an enclosure, so that the air circulation relative to the paper web 1 is reduced in this region. A high humidity is therefore generated or can be maintained within the housing 5. If necessary steam could be introduced into the housing to control the humidity outside of the web. This is illustrated at 11. The idea here is to retain some of the moisture expelled from the central layers of the web in the surface layers so that these are kept sufficiently moist for the smoothing action of the rolls 2.

The cooling of the outer layers of the paper web 1 can for example, as shown in FIG. 1, take place via the cooled rolls 2 of the smoothing mechanism or, as shown in FIG. 2, via cooled rolls 4 which are additionally arranged between the paper web heating device and the rolls 2 of the smoothing mechanism within the housing 5. In the Figs. the cooling of the rolls is effected by a supply of coolant to the inside of the rolls. This is effected by pump 6 for the coolant which directs the coolant to the interior of the rolls via the lines 7. The return flow of coolant 8 which has extracted heat from the rolls passes into a sump 9 where cooling takes place. If necessary a heat exchanger 10 can be inserted in the return line for the coolant and the heat extracted by the heat exchanger which can optionally be re-used elsewhere in the paper making process.

The condensation which eventually takes place on the rolls 4, or on the smoothing rolls 2, due to cooling thereof, is transferred into the outer layers and improves the moisture distribution further in the sense that the outer layers become moister than the inner layers.

It is admittedly known to cool paper webs during the making of paper, this is for example described in European Patent Application No. 89 106 932.0 published under the Publication No EP-A-03 41 457. The process described there is however quite different. The intention there is to cool the paper web prior to feeding it to heated smoothing rollers. Through the cooling effected prior to the smoothing rollers the inner layers of the web are cooled whereas on passing through the rollers the outer layers are heated. In this way a greater temperature differential can be provided between the inner and outer layers of the web which is claimed to be beneficial for smoothing the web while avoiding substantial reduction of the volume thereof. It will however be noted that the smoothing rollers are heated. The aforementioned European Patent Application No. 89 106 932.0 admittedly also has a further embodiment in which one of the rolls of the smoothing rolls is cooled. However this embodiment is only used when just one surface of the web is to be smoothed. The cooling is not used there for the purpose of improving the moisture content of the outer layers of the web or for reducing the heat loss from the smoothing mechanism.

A conceptually similarly process is also described in U.S. Pat. No. 2,214,641. However, in this reference steam is added to the paper web which is subsequently cooled by cooled calender rollers and then passed to heated calender rollers for smoothing with the addition of further steam. As pointed out above, it is an aim of the present invention to avoid or at least minimize the addition of further moisture to the paper web since moisture added has to be extracted again with the expenditure of further energy. In contrast the present invention seeks to produce smoothing by re-distribution of the water already present in the web and this is a concept which is not disclosed by any of the discussed prior art specifications.

I claim:

1. An apparatus for smoothing a paper web having inner layer and two outer surface layers, each layer with moisture content, comprising:

a smoothing mechanism in the form of at least one pair of smoothing rolls, said rolls defining a nip there between for the passage of said paper web through said nip in a direction from a supply side to a discharge side;

said rolls having means for applying pressure to said paper web on passage of said paper web through said nip;

a dielectric paper web heating device acting across said inner and outer layers of said paper web positioned up-stream of and in front of said rolls of said smoothing mechanism relative to said direction of web movement in order to generate in said paper web having said inner and outer layers a simultaneous heating of both said inner and outer layers with a degree of heating of said layers depending upon the moisture content of said inner and outer layers;

whereby said dielectric paper web heating device causes a moisture distribution across the inner and outer layers with the moisture content of the inner layer is at least substantially less than or at equal to the moisture content in the outer layers.

2. An apparatus for smoothing a paper web having inner and outer layers, according to claim 1 further including:

means for reducing air circulation over said surface layers of said web provided around said dielectric paper web heating device.

3. An apparatus for smoothing a paper web having inner and outer layers, according to claim 1 further including:

means for generating a high humidity over outer layers of said web is provided over said dielectric paper web heating device.

4. An apparatus for smoothing a paper web having inner and outer layers, according to claim 3 further including:

said means for generating a high humidity includes a housing surrounding said dielectric paper web heating device; and, means for introducing steam into said housing.

5. An apparatus for smoothing a paper web having inner and outer layers, according to claim 1 further including:

means for cooling at least one of said rolls of said smoothing mechanism.

6. An apparatus for smoothing a paper web having inner and outer layers, according to claim 1 further including:

further rolls are arranged between said rolls of said smoothing mechanism and said dielectric paper web heating device; and, means for cooling at least one of said further rolls.

7. An apparatus for smoothing a paper web having inner and outer layers, according to claim 1 further including:

said paper web has a moisture content of 5–25% from said supply side and a moisture distribution and 2–15% thereafter.

* * * * *